US006104896A

United States Patent [19]

Zaman et al.

[11] Patent Number: 6,104,896

[45] Date of Patent: Aug. 15, 2000

[54] APPARATUS AND METHOD FOR FORMING AN INTERFERENCE FIT

[75] Inventors: Kamran U. Zaman; George A. Schutt, both of Pittsford; Timothy J. Leenhouts, Fairport, all of N.Y.

[73] Assignee: Xerox Corporation, Stamford, Conn.

[21] Appl. No.: 09/354,812

[22] Filed: Jul. 16, 1999

[51] Int. Cl.[7] ..... G03G 15/00

[52] U.S. Cl. ..... 399/117; 29/407.08; 29/718; 29/895.22; 399/159

[58] Field of Search ..... 29/895.2, 895.22, 29/407.01, 407.08, 407.1, 714, 717, 718; 399/159, 167, 116, 117; 492/47

[56] References Cited

U.S. PATENT DOCUMENTS

| | | | |
|---|---|---|---|
| 4,100,480 | 7/1978 | Lytle et al. | 340/870.35 |
| 4,120,576 | 10/1978 | Babish | 399/116 |
| 4,400,077 | 8/1983 | Kozuka et al. | 399/117 |
| 4,561,763 | 12/1985 | Basch | 399/116 |
| 4,914,478 | 4/1990 | Yashiki | 399/117 |
| 5,357,321 | 10/1994 | Stenzel et al. | 399/167 |
| 5,402,207 | 3/1995 | Michlin | 399/117 |
| 5,461,464 | 10/1995 | Swain | 399/159 |
| 5,599,265 | 2/1997 | Foltz | 492/47 |
| 5,630,196 | 5/1997 | Swain | 399/117 |
| 5,634,175 | 5/1997 | Michlin et al. | 399/90 |
| 5,815,773 | 9/1998 | Zaman | 399/117 |
| 5,845,173 | 12/1998 | Zogg et al. | 399/117 X |
| 5,893,203 | 4/1999 | Buttrick, Jr. | 29/407.05 |
| 5,966,802 | 10/1999 | Sonntag et al. | 29/714 |

*Primary Examiner*—Sophia S. Chen

[57] ABSTRACT

An assembling device insures that the proper interference fit is obtained between a flange device and a hollow cylindrical member into which the flange device is inserted. During the insertion of the flange, the hollow cylindrical member is held in place so that it does not move. A displacement sensor monitors the assembly stroke or the distance the flange is inserted and a force sensor is used to measure the assembly force. Threshold values of the displacement and assembly force are set for each flange device and hollow cylindrical member. The flange device displacement and assembly force are communicated to an assembly indicator. A force and/or displacement value above or below the predetermined threshold value will trigger a signal which alerts an operator to improper assembly of the flange device to the hollow cylindrical member.

18 Claims, 4 Drawing Sheets

APPARATUS AND METHOD FOR FORMING AN INTERFERENCE FIT

This patent application is related to concurrently filed patent application entitled "Interference Fit Conductive Flange Device" (D99157) to Zaman et al., application Ser. No. 09/356,121 filed Jul. 16, 1999, now pending, which is assigned to the same assignee as the present invention. This invention relates in general to an apparatus and method for forming an interference fit between a hollow cylindrical support member and a flange device without the use of an adhesive or additional grounding member.

BACKGROUND OF THE INVENTION

The xerographic imaging process begins by charging a photoconductive member to a uniform potential, and then exposing a light image of an original document onto the surface of the photoreceptor, either directly or via a digital image driven laser. Exposing the charged photoreceptor to light selectively discharges areas of the surface while allowing other areas to remain unchanged, thereby creating an electrostatic latent image of the document on the surface of the photoconductive member. A developer material is then brought into contact with the surface of the photoreceptor to transform the latent image into a visible reproduction. The developer typically includes toner particles with an electrical polarity opposite that of the photoconductive member. A blank copy sheet is brought into contact with the photoreceptor and the toner particles are transferred thereto by electrostatic charging the sheet. The sheet is subsequently heated, thereby permanently affixing the reproduced image to the sheet. This results in a "hard copy" reproduction of the document or image. The photoconductive member is then cleaned to remove any charge and/or residual developing material from its surface to prepare it for subsequent imaging cycles.

Electrostatographic imaging members are well known in the art. One type of photoreceptor conventionally utilized for copiers and printers comprises a hollow electrically conductive drum substrate which has been dip coated with various coatings including at least one photoconductive coating comprising pigment particles dispersed in a film-forming binder. These photoreceptors are usually supported on an electrically conductive shaft by drum supporting hubs or end flanges. The hubs are usually constructed of plastic material and have a hole through their center into which a supporting axle shaft is inserted. Since hubs are usually constructed of electrically insulating plastic material, an electrical grounding means comprising a flexible spring metal strip is secured to the hub and positioned to contact both the electrically conductive axle shaft and the electrically conductive metal substrate of the photoreceptor drum. One type of grounding means is illustrated in U.S. Pat. No. 4,561,763 to Basch issued Dec. 31, 1985, the contents of which are hereby incorporated by reference. A drum supporting hub is disclosed having a tapered pot-like hub configuration comprising a bottom section and a rim, the rim comprising a plurality of circumferentially spaced resilient fingers extending at a slight incline outwardly from the axis of the pot-like hub away from the bottom section, at least three of the fingers having lips at the ends of the fingers, the lips projecting away from the axis for engagement with an end of a cylindrical drum upon insertion of the pot-like hub into the drum, the rim other than the lips having an outside diameter slightly larger than the outside diameter of the bottom. The drum supporting hub is employed in a drum assembly comprising the hub, a cylindrical drum having a circular cross-section and a shaft positioned along the axis of the drum. In one embodiment the hub is plastic, which is made of or coated with an electrically conductive material to permit electrical grounding of the drum through a shaft passing through the hub. In another embodiment, a metal shim is utilized to electrically ground the drum to the shaft.

Unfortunately, this metal ground shim is often bent out of alignment when inserted into one end of a photoreceptor drum. Such misalignment can result in the metal strip not contacting the interior of the drum or the axle or both after insertion of the hub into the end of the drum is completed. Further, coatings electrically insulating in the dark that are formed on the surface of the interior of the drum during dip coating can adversely affect electrical grounding of the drum to the electrically conductive drum axle shaft. If inadequate electrical grounding of the drum to the axle shaft is detected after the drum has been inserted into a modular replacement unit in which photoreceptor and various other subsystems such as cleaning and charging units are permanently mounted, repair of the drum is usually impossible without destruction of the module.

Photoreceptors presently available in the art are often secured to the hub or end flange with a thermosetting resin adhesive. An example of this type of device is disclosed in U.S. Pat. No. 4,914,478 to Yashiki issued Apr. 3, 1990, the contents of which are hereby incorporated by reference. However, recycling of used drums having glued hubs is difficult, if not impossible, because of damage to the hub or the drum or both during removal of the hub from the drum by common techniques such as by hammering. Such removal techniques damage or destroy both the drum and the hub. Further, where disassembly is accomplished without damage, cleaning of both the hub and the cylindrical substrate is required to remove adhering adhesive. In addition, adhesive application equipment utilized during mounting of an end flange to a cylindrical substrate are difficult to maintain because the adhesive has a short pot life and often solidifies and clogs the equipment thereby requiring time consuming efforts to clean and remove the solidified adhesive. The use of bolts and nuts to secure hubs to drums requires time intensive activity and does not address the problem of electrically grounding a drum substrate to the drum axle shaft.

One existing end flange device which avoids the use of adhesive materials is U.S. Pat. No. 5,357,321 to Stenzel et al. issued Oct. 18, 1994, which utilizes resilient fingers having pointed tips that dig into and penetrate the inner surface of the drum. A drum supporting hub is disclosed comprising a disk shaped member having a circular periphery, a hole extending axially through the center of the disk shaped member, and at least one long thin electrically conductive resilient member secured to the disk shaped member, the resilient member having a central section adjacent the hole and having opposite ends, each of the ends terminating into at least one pointed tip adjacent the circular periphery of the disk shaped member, and the resilient member having a major plane substantially parallel to the axis of the disk shaped member. This hub may be inserted in at least one end of a cylindrical electrostatographic imaging member to produce an imaging member assembly. While this hub may adequately support the photoreceptor, the pointed tips can for m scratches and grooves in the interior surface of the drum during installation, use and removal. These scratches or grooves can adversely affect recycling of the cylindrical substrate.

Another glueless arrangement is disclosed in U.S. Pat. No. 5,461,464 to Swain issued Oct. 24, 1995, which discloses a photoreceptor assembly including a substrate coated with a photoconductive material, and with flange members engaged with the end sections of the substrate. The flange member engaged with the first end section is comprised of a projection which fits into the surface hole of the first end section. The flange member at the second end includes a projection which fits into a surface hole that resides in the second end section. There is no adhesive present between the engaging surfaces of the substrate and the flange members.

U.S. Pat. No. 5,630,196 to Swain issued May 13, 1997, discloses a hollow cylinder supporting end flange including a disk shaped member having a circular periphery and a coil spring having a major plane substantially parallel to the major plane of the disk shaped member. The coil spring also has an exposed arcuate outer periphery with a diameter larger than the inside diameter of the hollow cylinder, an outer exposed end and an inner end, with the inner end comprising a section secured to the end flange and the exposed arcuate outer periphery of the coil spring being adjacent the circular periphery of the disk shaped member for engagement with a hollow cylindrical member upon insertion of the coil spring into the hollow cylindrical member. The end flange may be utilized as a component of an assembly including a hollow cylindrical electrostatographic imaging member having a circular cross section and an inner surface, and an end flange secured to at least one end of the hollow cylindrical member by a partially wound coil spring, the spring having an inner end and an outer end, the inner end being secured to the end flange and the outer end having an exposed arcuate outer surface in frictional contact with the inner surface of the hollow cylindrical member. A process for fabricating this assembly is also disclosed.

U.S. Pat. No. 5,599,265 to Foltz issued Feb. 4, 1997 discloses a hollow cylinder supporting end flange comprising a disk shaped member, a supporting hub extending axially from the disk shaped member and an annular ring supported on the hub, the ring comprising a plurality of sharp protrusions or barbs extending from the ring in a direction away from the hub for engagement with the hollow cylindrical member upon insertion of the annular ring into the hollow cylindrical member. This end flange is utilized in an assembly comprising a hollow cylindrical member having a circular cross section and an inner surface and an end flange comprising a disk shaped member having a circular periphery, a supporting hub extending axially from the disk shaped member into one end of the hollow cylindrical member and an annular ring supported on and secured to the hub, the ring comprising a plurality of sharp protrusions extending from the ring in a direction away from the hub into engagement with inner surface of the hollow cylindrical member to secure the hollow cylindrical member to the end flange.

U.S. Pat. No. 4,400,077 to Kozuka et al. issued August 1983 discloses a photosensitive drum assembly for an electrostatic copying apparatus which includes a cylindrical drum with a photosensitive layer around its outer periphery. The drum is held between a pair of flanges at opposite axial ends of the drum. Each of the flanges is formed having a diameter larger than the external diameter of the drum. At the edge of each flange is a cylindrical portion extending along the axis of the drum to face toward the opposite flange. The end edges of the drum closely fit into the cylindrical portions.

U.S. Pat. No. 4,120,576 to Babish issued Oct. 17, 1978 discloses a drum support apparatus including outboard and inboard hubs having outer surfaces and adapted for interface fitting with the inside surface of the drum. The hubs are supported on a shaft that is cantilevered from a frame and have recessed areas on central portions to cooperate with locking tabs located on a tubular member loosely fitted on the shaft.

U.S. Pat. No. 5,402,207 to Michlin issued Mar. 28, 1995 teaches a conductive photoreceptor drum gear that may be made of metal. When the bushing for the gear is smooth metal, a conductive joining material is used to fix the bushing with respect to the photoreceptor, insuring electrical contact between the bushing and the photoreceptor. When the bushing for the gear has prongs, the prongs dig into the inner wall of the photoreceptor and establish electrical contact with the photoreceptor. When the bushing for the gear is knurled, the knurls cut into the inner wall of the photoreceptor to establish electrical contact with the photoreceptor and a non-conductive joining material can be used to insure that the gear is fixed with respect to the photoreceptor.

U.S. Pat. No. 5,634,175 to Michlin et al. issued May 27, 1997 teaches an electrical contact device for a developer roller in a toner cartridge. A developer roll contact device having a smooth flange which fits snugly inside the end of the developer roll and is used to establish electrical contact between the developer roller and the printer electrical contact. Developer roller contact device may be made of conductive plastic and may be fitted to the developer roller without adhesive.

U.S. Pat. No. 5,815,773 to Zaman issued Sep. 29, 1998 discloses a composite photoreceptor flange with an end flange made from a composition which includes polycarbonate, polytetrafluoroethylene, and glass. The mounting of the end flange in the photoreceptor does not require the use of an adhesive material. A grounding plate is necessary in order to provide an electrical ground for the photoreceptor.

U.S. Pat. No. 4,100,480 to Lytle et al. issued Jul. 11, 1978 teaches a position and velocity sensor. A linear voltage differential transformer is used to control the positioning of an element at either of two positions.

U.S. Pat. No. 5,893,203 to Buttrick, Jr. issued Apr. 13, 1999 discloses a process for seating a tight-fitting headed fastener in a hole in a workpiece so that the head of the fastener contacts the workpiece. A fastener is inserted into a hole in the workpiece and a driver contacts the head of the fastener and senses and records the position of the fastener head to determine how far the fastener must be driven into the hole to seat the fastener head against the workpiece surface.

All of the references cited herein are incorporated by reference for their teachings.

Accordingly, although known apparatus and processes are suitable for their intended purposes, a need remains for an apparatus which is capable of supporting hollow cylindrical support members without the use of an adhesive, to facilitate recycling.

SUMMARY OF THE INVENTION

In accordance with the present invention, an apparatus for forming an interference fit between a flange device, which includes a flange, and a hollow cylindrical member having a first end and a second end is disclosed. The apparatus includes a support for supporting the hollow cylindrical member so that the flange device may be located with respect to the first end of the hollow cylindrical member, a force member for applying a force to the flange device such that the flange is inserted into the hollow cylindrical member to form the interference fit, a displacement sensor for sensing the distance the flange is inserted into the hollow cylindrical member, a load sensor for sensing the force supplied by the force member; and an assembly indicator which uses sensor readings from the displacement sensor and the load sensor to determine whether the interference fit meets predetermined force and distance assembly specifications. The flange has a length, an inner diameter, and an outer diameter, such that the outer diameter of the flange is sized with respect to the inner surface of the hollow cylindrical member and the length of the flange is such that an interference fit is formed between the flange and the inner surface of the hollow cylindrical member, the interference fit being maintained in the absence of an adhesive.

Another aspect of the invention is drawn to a method of forming an interference fit between the outer surface a flange, and an inner surface of a hollow cylindrical member having a first end and a second end. The method includes supporting the hollow cylindrical member so that the flange may be located with respect to the first end of the hollow cylindrical member; applying an assembly force with a force member to the flange such that the flange is inserted into the hollow cylindrical member to form the interference fit; sensing the distance the flange is inserted into the hollow cylindrical member with a displacement sensor; sensing the assembly force supplied by the force member with a load sensor; and determining whether the interference fit meets predetermined force and distance assembly specifications, wherein the flange has a length, an inner diameter, and an outer diameter, such that the outer diameter of the flange is sized with respect to the inner surface of the hollow cylindrical member and the length of the flange is such that an interference fit is formed between the flange and the inner surface of the hollow cylindrical member, the interference fit being maintained in the absence of an adhesive.

BRIEF DESCRIPTION OF THE DRAWINGS

Other features and advantages of the present invention will become apparent as the following description proceeds and upon reference to the drawings, in which.

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

DETAILED DESCRIPTION OF THE PREFERRED EMBODIMENT

While the present invention may be employed in any suitable device that requires support for a drum, it will be described herein with reference to and more specifically to a conductive composite end flange for supporting hollow cylindrical support members in an electrostatographic imaging system without the use of an adhesive.

Figure 1:
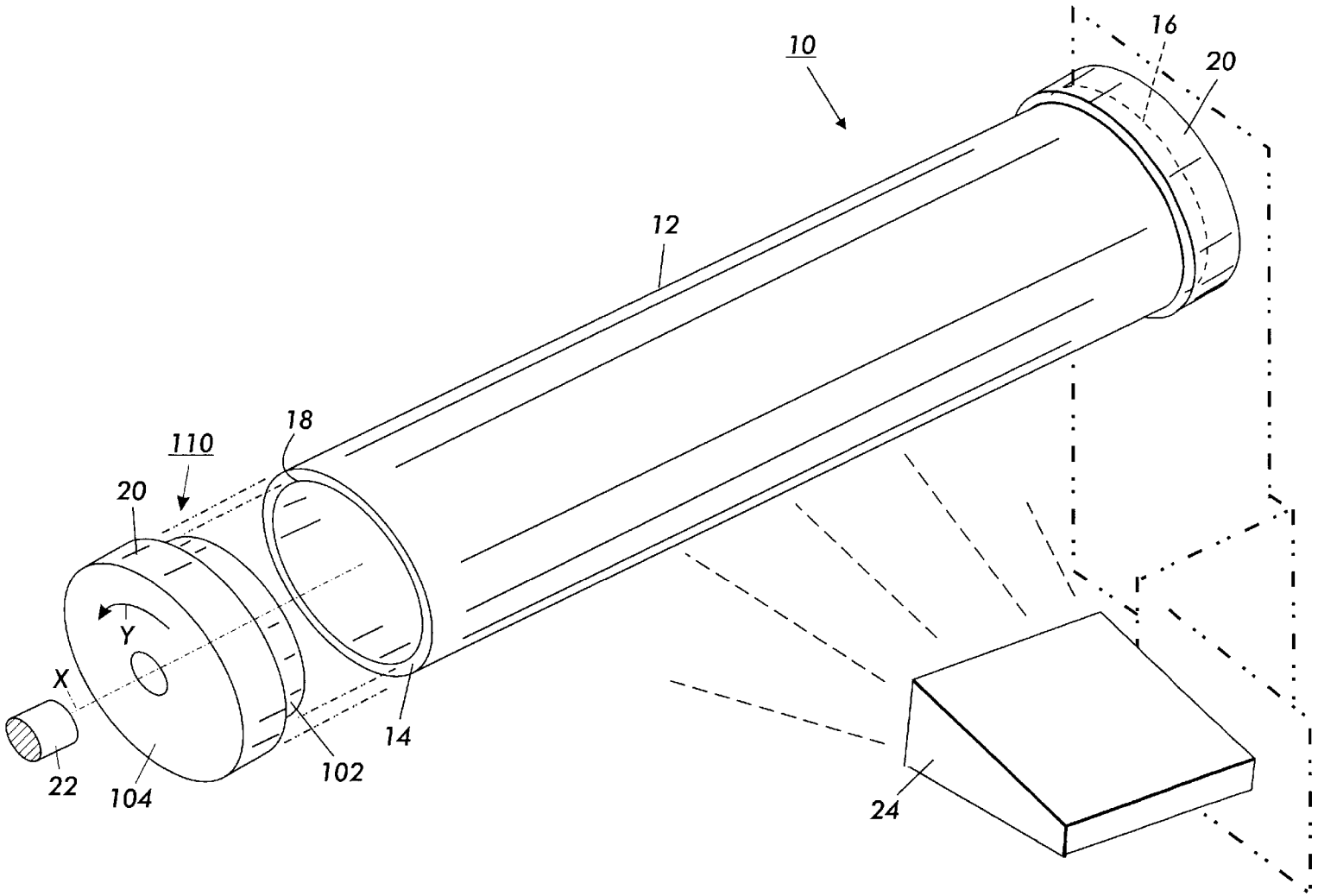
FIG. 1 depicts a schematic, three dimensional view of the conductive flange device of the present invention as it is mounted to an electrostatographic photoreceptor.

Referring now to the drawings where the showings are for the purpose of describing an embodiment of the invention and not for limiting same, FIG. 1 depicts a schematic, three dimensional view of the conductive photoreceptor flange of the present invention, mounted to an electrostatographic photoreceptor as indicated by 10. Flange 102 is connected to flange support member 104. Flange and flange support member form flange device 110. Photoreceptor 12 has inner diameter 18 for engaging flange 102. Photoreceptor support 22 supports flange device 10. Photoreceptor support 22 is conductive and completes the electrical ground circuit between photoreceptor 12 and flange device 110 and the xerographic system. Of course photoreceptor support 22 need not pass through the entire length of the photoreceptor, it being well-known to have a shaft on each end of a photoreceptor to separately support each flange device. Photoreceptor support 22 could also take the form of a drive dog, a conductive shoe or a conductive roller which contact flange support 104 to drive photoreceptor 12, rather than a gear as shown and discussed below.

In the embodiment shown, flange support member 104 includes a gear 20 or similar device which is mounted to an outside source such as a motor (not shown) to cause rotation of gear 20 about axis x as indicated by arrow y. Gear 20 is attached to one or both ends 14 and 16 of photoreceptor 12, causing photoreceptor 12 to rotate past corona device 24 for charging of the photoreceptor to a uniform electrostatic potential. A light image of an original document is exposed onto the surface of photoreceptor 12 to form an image on the photoreceptor surface. A developer material is then brought into contact with the surface of the photoreceptor to transform the latent image into a visible reproduction.

Figure 2:
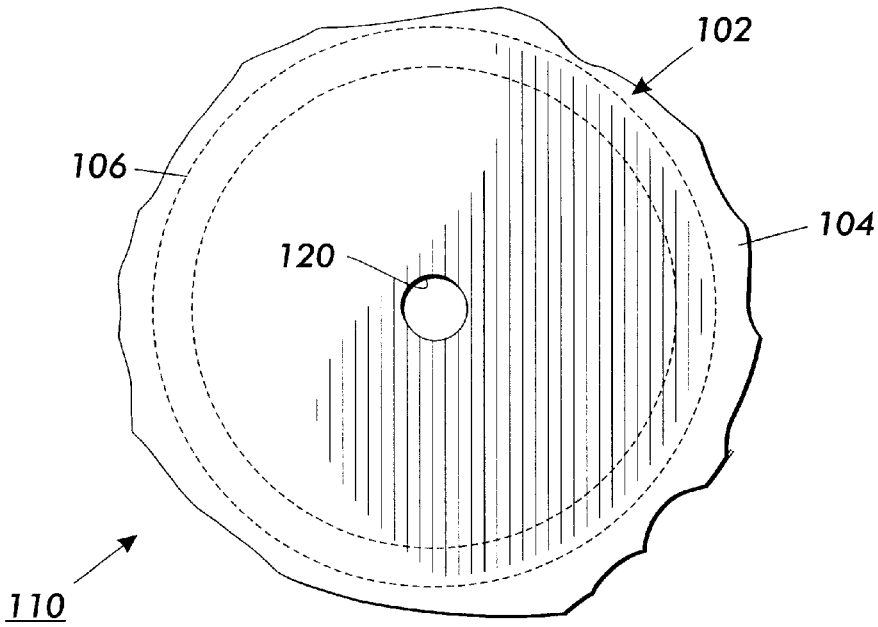
FIG. 2 depicts a front view of the conductive composite flange of the present invention.
Figure 3:
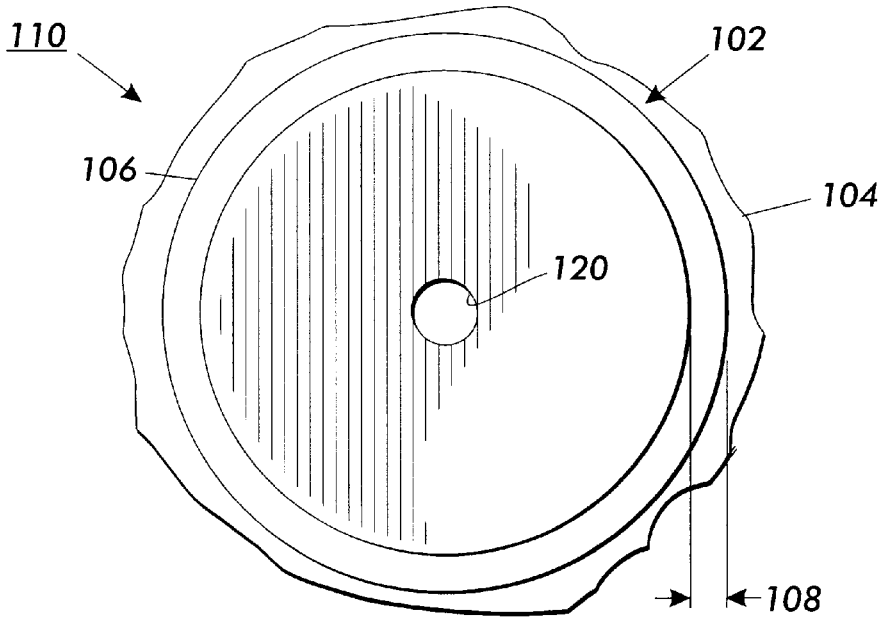
FIG. 3 depicts a rear view of the conductive composite flange of the present invention.
Figure 4:
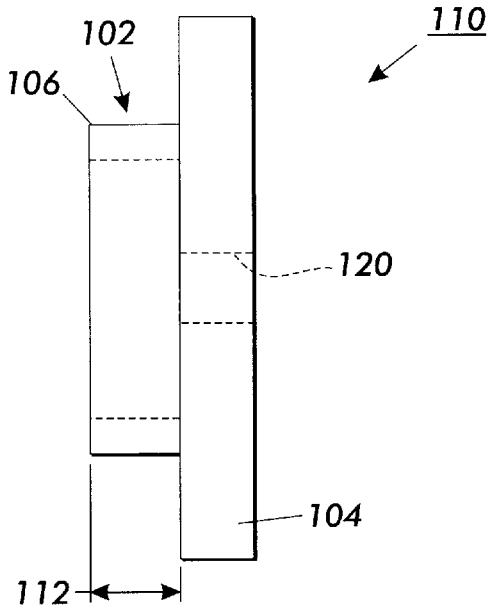
FIG. 4 depicts a side view of the conductive composite flange device of the present invention.
Figure 5:
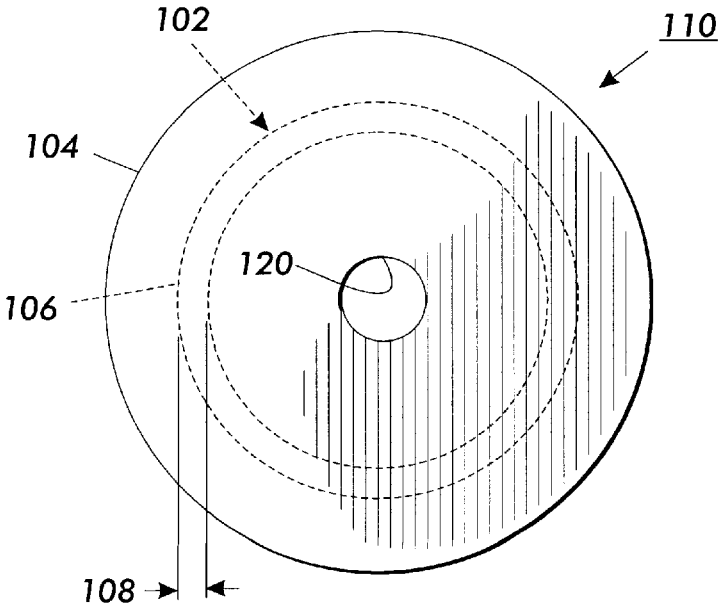
FIG. 5 depicts a front view of the flange device.

FIGS. 2 and 3 depict front and rear views of conductive photoreceptor flange 102 of the present invention. As shown, flange 102 has an outer diameter 106, and a thickness 108. Referring now to FIGS. 4 and 5 flange 102 has a length 112, to assist in providing torsional and axial support for photoreceptor 12. Flange support 104 has opening 120 formed therethrough for insertion of photoreceptor support 22 in the xerographic machine. As indicated above, photoreceptor 12 rotates about axis x in the y direction, due to the rotation of gear 20. As shown, photoreceptor support 22 is a shaft, however may be any type of well-known supports and may include a dog that attaches directly to flange support 104 and transmits the torsional force. Flange 102 serves to transfer the torsional force applied by the outside source from gear 20 to photoreceptor 12. While flange 102 provides axial as well as torsional support, the primary loads applied to it result from the torque from the outside source. Photoreceptor 12 must often operate under torsional loads of as much as 45 lbs-in. Thus, flange 102 must be able to withstand loads of this magnitude in order to successfully transfer the required torque from an outside source, such as a motor (not shown), to photoreceptor 12. The magnitudes of length 112, and outer diameter 106 must both be considered when flange 102 is being designed. If design constraints unrelated to rotation of photoreceptor 12 (such as the configuration of the cavity of the machine) place limitations on either or both of these dimensions, length 112 can be changed as long as outer diameter 106 is altered accordingly. For example, a longer photoreceptor 12 with a relatively small diameter can be supported with flange 102 as long as the decrease in outer diameter 106 is accompanied by a proportional increase in length 112. Similarly, a machine that requires the use of a relatively short photoreceptor 12 can be supported by flange 102 as long as outer diameter 106 can be increased along with any required decrease in length 112.

Prior to assembly, outer diameter 106 is slightly larger than the inner diameter 18 of photoreceptor 12. Flange 102 must be forced into the inside of photoreceptor 12 such that outer diameter 106 will come in firm contact with the inside surface of photoreceptor 12. This requires photoreceptor 12 to be manufactured such that it will expand slightly in the outward radial direction as flange 102 is inserted into its inside surface. This also requires flange 102 to be strong enough to withstand the inner radial compression load that will then be exerted upon it, once it has been press fit into the inside of photoreceptor 12 and maintain the interference fit throughout the printer operating temperature range. Preferably, the outer surface of flange 102 is controlled in order to prevent scratching or gouging of the inner surface of photoreceptor 12 and to optimize the friction between the inner surface of photoreceptor 12 and the surface of flange 102. A minimum micro-roughness of the flange surface is necessary to obtain the coefficient of friction needed to maintain the interference fit between the flange and the photoreceptor.

The present invention includes forming flange 102 from a composite material which is a combination of plastic and a conductive material compatible with the plastic in an amount sufficient to form an electrical ground path between the photoreceptor and flange. The plastic needs to have a high impact strength and high softening temperature. This combination of component materials provides strength, dimensional stability and friction coefficient to withstand the torsional force that is applied to the photoreceptor/flange mating surface during the printing operation and to the inner compression load that is applied to the flange during and after assembly.

The coefficients of thermal expansion of the photoreceptor drum and the flange need to be matched so that the interference fit is maintained independent of the temperature. The coefficient of thermal expansion depends upon the type of material used and the dimensions of the material affect the amount of thermal expansion. Matching the coefficients of thermal expansion of the flange 102 and photoreceptor 12 is critical in electrophotographic systems where the temperature can range between 40 to 150 degrees Fahrenheit. Of course, the coefficients of thermal expansion will change with the type of material used, however it is possible to match the thermal coefficients of thermal expansion for differing flange and photoreceptor materials.

Minimizing the mass of the flange while providing for the necessary surface area contact between the flange 102 and photoreceptor 12 inner diameter 18 allows for optimum heat transfer. It is desired that flange thickness 108 be as thin as possible, however flange thickness must be adequate to support the torque it must withstand during insertion and machine operation.

In one embodiment, flange 102 is made from 82% polycarbonate, 12% carbon, and 6% TetraFluorEthylene (TFE), referred to as M2386 and which is supplied by DSM Engineering Plastics, Evansville, Indiana. The M2386 product provides good thermal loading characteristics but other combinations of these elements may be used, and the invention is not limited to this embodiment. In a preferred embodiment, the thermal coefficient of expansion for a photoreceptor made of aluminum is approximately 13.6 millionths of an inch per inch per degree Fahrenheit, while for the flange made of M2386 the thermal coefficient of expansion is approximately 15 millionths of an inch per inch per degree Fahrenheit. Those skilled in the art will also recognize that it is even possible to practice the invention by substituting similar or equivalent material for those listed. For example, the plastic may be any polymer plastic which can be mixed with carbon or metal flakes to create a conductive polymer mix. Various other non-stick materials which may be substituted for TFE are FluorinatedEthylenePropylene (FEP), PolyTetraFluoroEthylene (PTFE), Ethylene-ChloroTrifluoroEthylene (ECTFE), PerFluoroAlkoxy resin (PFA), Ethylene-TetraFluoroEthylene (ETFE), PolyChloroTrifluorEthylene (PCTFE) and PolyVinyladeneFluoride (PVDF).

Flange device 110 may be for med by any well-known fabrication processes such as injection molding, machining or reaction injection molding. Preferably, flange 102 and flange support 104 are integrally formed, however they may be fabricated separately from the same or different materials and then joined together to form flange device 110. In a preferred embodiment flange length 112 is 7.5 mm, flange thickness 108 is 3.54 mm, flange inner diameter is 28.5 mm and flange outer diameter is 35.4 mm, photoreceptor inner diameter is 28.5 mm and photoreceptor outer diameter is 30.0 mm, with the thickness of photoreceptor being 0.75 mm.

Figure 6:
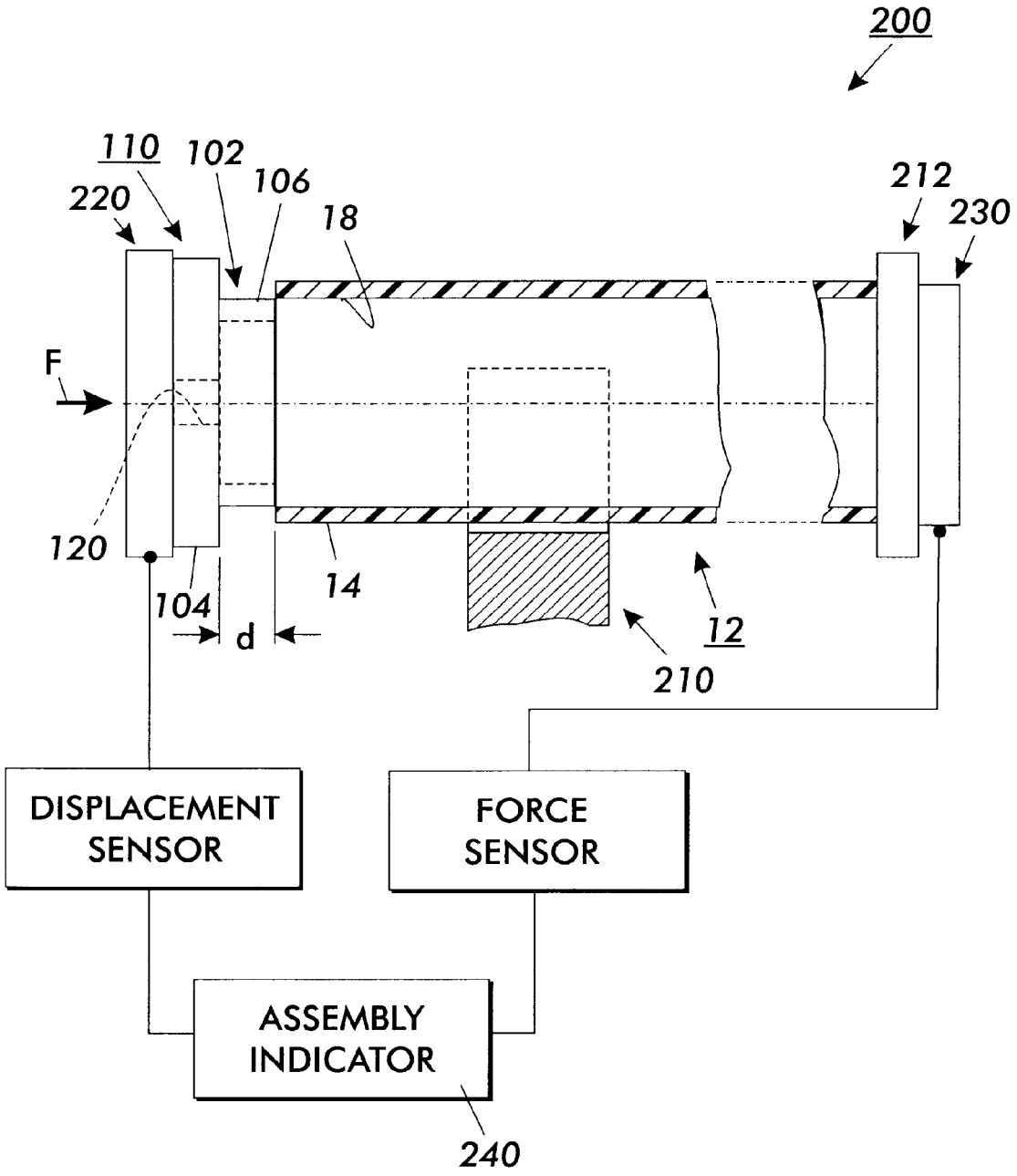
FIG. 6 depicts a schematic view of the assembly device for inserting the flange device.

Turning now to FIG. 6, where an assembling apparatus 200 for assembling flange device 110 to photoreceptor 12 is shown. There is a need to assure that after flange device 110 is assembled to photoreceptor 12 that the interference fit formed therebetween will meet the torque and proper assembly requirements between the photoreceptor 12 and flange 102. Photoreceptor 12 is supported by V-block 210 and stop block 212, which hold the photoreceptor in place during insertion of flange 102. Stop block is fixed in place. Assembling apparatus 200 uses a displacement sensor 220 to monitor the assembly stroke or the distance d flange 102 is inserted and a force sensor 230 to measure assembly force F. Threshold values of the displacement and assembly force are set for each device and detected by assembly indicator 240. A force and/or displacement value above or below the threshold value will trigger a signal which alerts an operator to improper assembly of the flange device 10 with photoreceptor 12.

As set forth above, with correct material, diameter and thickness choices for flange 102 and photoreceptor 12, and flange length 112 for flange 102 an interference fit can be formed to withstand the torsional forces to which the flange and photoreceptor are subjected during machine operation. The amount of torque the interference fit can withstand is directly related to the tightness of the interference fit. There are problems if the interference fit is too low or too high.

One aspect of the interference fit depends upon the size of the outer diameter 106 of flange 102 with respect to the inner diameter 18 of photoreceptor 12. Where the flange outer diameter is about the same as the photoreceptor inner diameter, a relatively low insertion force is required, which results in a relatively low interference fit. There is a minimum interference fit that will support the torque requirements of the operating flange and photoreceptor.

To withstand the operating torque requirements, outer diameter 106 of flange 102 must be larger than inner diameter 18 of photoreceptor 12. As the outer diameter of flange 102 increases in size with respect to the inner diameter of photoreceptor 12, the interference fit increases and thus the torque the assembled flange and photoreceptor can withstand increases. However, there is a point where the interference fit becomes too high. This occurs when the inserted flange causes the photoreceptor end 14 to bulge excessively at its end due to the fact that the flange outer diameter 106 is sized too large with respect to the photoreceptor inner diameter 18. In the case of pliotoreceptors, the maximum interference fit occurs when the inserted flange diameter begins to affect the total indicated runout (TIR) of the photoreceptor. It is important to keep the TIR below specified parameters in order to insure the proper operation of the photoreceptor. See the above preferred embodiment for an example of sizing the flange with respect to the photoreceptor.

Another aspect of the interference fit depends upon the distance flange 102 is inserted into photoreceptor 12. The further the flange is inserted into the photoreceptor, the greater the surface contact area. It is important that distance d is the same as flange length 112 to assure proper seating and alignment of flange 102 into photoreceptor 12.

To insure that the proper interference fit is achieved between flange 102 and photoreceptor 12 assembly apparatus 200 is used. Flange 102 of flange device 110 is initially placed in photoreceptor end 14 as shown in FIG. 6 by any known placement method such as manually or robotically. Assembly force F is then applied to the end of flange device 110 as shown, which pushes flange 102 a distance d. The desired assembly force F has been previously determined based on the size of the outer diameter 106 of flange 102 and the size of the inner diameter of the photoreceptor so that a good interference fit is obtained. The desired insertion distance d has also been designed based on the flange outer diameter and photoreceptor inner diameter to insure the desired interference forces. The optimum size of the outer diameter of the flange with respect to the inner diameter of the photoreceptor and distance d are specified to achieve an interference fit that can withstand up to 45 lbs-inch torque during operating conditions.

During the flange insertion, distance d is measured by displacement detector 220 such as a linear variable differential transformer (LVDT) and assembly force F is measured by force sensor 230 such as a load cell. Force sensor is rigidly attached to stop block 212. In the preferred embodiment described above, the assembly force is approximately 60 lbs-in. All force exerted axially on the photoreceptor is measured by force sensor 230. This information is then communicated to assembly indicator 240 which uses the measured assembly force F and the measured distance d to insure that the correct force has been applied over the correct distance. If both the measured assembly force F and measured distance d meet the previously determined desired measurements, then the interference fit will withstand the operating torque requirements. If either of these parameters is not met during the flange assembly process, then the assembly is deemed to have been improper. The defective interference fit information is indicated by assembly indicator 240. The assembly apparatus provides for very valuable quality control that measures the interference fit during, rather than after, the assembly process.

Flange 102 may be inserted in the photoreceptor ends one at a time or two at the same time. If two flange devices are inserted at the same time, then additional care must be taken to insure that the photoreceptor is sufficiently held in place by V-block 210 in order to withstand the forces applied at both ends. Also, when two flange devices are inserted at the same time or the photoreceptor is held in place, another component of the assembly device at the other end is necessary to measure the assembly force and distance d.

It is, therefore, apparent that there has been provided in accordance with the present invention, a method and apparatus for forming an interference fit between a flange device and a hollow cylindrical member that fully satisfies the aims and advantages hereinbefore set forth. While this invention has been described in conjunction with specific embodiments thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for forming an interference fit between a flange device, which includes a flange, and a hollow cylindrical member having a first end and a second end comprising:

a support for supporting the hollow cylindrical member so that the flange device may be located with respect to the first end of the hollow cylindrical member;

a force member for applying a force to the flange device such that the flange is inserted into the hollow cylindrical member to form the interference fit;

a displacement sensor for sensing the distance the flange is inserted into the hollow cylindrical member;

a force sensor for sensing the force supplied by the force member; and an assembly indicator which uses sensor readings from the displacement sensor and the force sensor to determine whether the interference fit meets predetermined force and distance assembly specifications, wherein the flange has a length, an inner diameter, and an outer diameter, such that the outer diameter of the flange is sized with respect to an inner surface of the hollow cylindrical member and the length of the flange is such that an interference fit is formed between the flange and the inner surface of the hollow cylindrical member, the interference fit being maintained in the absence of an adhesive.

2. An apparatus as claimed in claim 1, wherein the flange is made of conductive plastic and the hollow cylindrical member is made of metal.

3. An apparatus as claimed in claim 1, wherein the support includes a stop block against which the second end of the hollow cylindrical member rests.

4. An apparatus as claimed in claim 3, wherein the force sensor is located near the stop block.

5. An apparatus as claimed in claim 1, wherein the displacement sensor is a linear variable differential transducer.

6. An apparatus as claimed in claim 1, wherein the force sensor is a load cell.

7. An apparatus as claimed in claim 1, wherein the hollow cylindrical member is a photoreceptor and the interference fit withstands operating torsional forces up to 45 pounds-inch applied to the flange and operating temperatures from about 40 to 150 degrees Fahrenheit.

8. An apparatus as claimed in claim 1, wherein the flange device and hollow cylindrical member are made of conductive material such that the interference fit forms a sole ground path between the hollow cylindrical member and the flange device.

9. An apparatus as claimed in claim 8, wherein the hollow cylindrical member is an electrostatographic member.

10. A method of forming an interference fit between the outer surface of a flange, and an inner surface of a hollow cylindrical member having a first end and a second end, comprising:

supporting the hollow cylindrical member so that the flange may be located with respect to the first end of the hollow cylindrical member;

applying an assembly force with a force member to the flange such that the flange is inserted into the hollow cylindrical member to form the interference fit;

sensing the distance the flange is inserted into the hollow cylindrical member with a displacement sensor;

sensing the assembly force supplied by the force member with a force sensor; and determining whether the interference fit meets predetermined force and distance assembly specifications, wherein the flange has a length, an inner diameter, and an outer diameter, such that the outer diameter of the flange is sized with respect to the inner surface of the hollow cylindrical member and the length of the flange is such that an interference fit is formed between the flange and the inner surface of the hollow cylindrical member, the interference fit being maintained in the absence of an adhesive.

11. The method as claimed in claim 10, wherein determining whether the interference fit meets predetermined force and distance assembly specifications includes an assembly indicator which uses sensor readings from the displacement sensor and the force sensor.

12. A method as claimed in claim 11, wherein assembly indicator alerts an operator if the predetermined force and distance assembly specifications are not met.

13. A method as claimed in claim 12, wherein the predetermined force and distance assembly specifications are based on torque requirements to which the flange will be subjected.

14. A method as claimed in claim 10, wherein supporting the hollow cylindrical member includes placing the second end of the hollow cylindrical member against a stop block.

15. A method as claimed in claim 14, further comprising:

locating the force sensor adjacent the stop block.

16. A method of forming an interference fit between the outer surface of a flange, and an inner surface of an electrostatographic hollow cylindrical member having a first end and a second end, comprising:

supporting the hollow cylindrical member so that the flange may be located with respect to the first end of the hollow cylindrical member;

applying an assembly force with a force member to the flange such that the flange is inserted into the hollow cylindrical member to form the interference fit;

sensing the distance the flange is inserted into the hollow cylindrical member with a displacement sensor;

sensing the assembly force supplied by the force member with a force sensor; and determining whether the interference fit meets predetermined force and distance assembly specifications, wherein the flange has a length, an inner diameter, and an outer diameter, such that the outer diameter of the flange is sized with respect to the inner surface of the hollow cylindrical member and the length of the flange is such that an interference fit is formed between the flange and the inner surface of the hollow cylindrical member, the interference fit being maintained in the absence of an adhesive.

17. The method as claimed in claim 16, wherein total indicated runout specifications for the electrostatographic hollow cylindrical member are met when the flange is inserted in the electrostatographic hollow cylindrical member.

18. The method as claimed in claim 16, further comprising:

forming a ground path between the flange and the electrostatographic hollow cylindrical member solely by the interference fit.

* * * * *